United States Patent [19]

Weiss et al.

[11] 4,263,981

[45] Apr. 28, 1981

[54] VACUUM PUMP EXHAUST MUFFLER

[75] Inventors: William R. Weiss, Walnut Creek, Calif.; Lee E. Remy, Colonial Heights, Va.

[73] Assignee: Allied Chemical Corporation, Morris Township, Morris County, N.J.

[21] Appl. No.: 8,006

[22] Filed: Jan. 31, 1979

[51] Int. Cl.[3] ..... F01N 1/02; F01N 1/10

[52] U.S. Cl. ..... 181/252; 181/273

[58] Field of Search ..... 181/243, 245, 252, 249–251, 181/255, 256, 257, 264, 265, 269, 272, 275, 204, 273, 247

[56] References Cited

U.S. PATENT DOCUMENTS

| | | | |
|---|---|---|---|
| 3,175,640 | 3/1965 | Matsui | 181/252 |
| 3,534,828 | 10/1970 | Iver | 181/204 |
| 3,581,842 | 6/1971 | Hall | 181/266 |
| 3,679,024 | 7/1972 | Kirkland, Jr. et al. | 181/273 |
| 4,024,698 | 5/1977 | Weiss et al. . | |
| 4,030,651 | 6/1977 | Weiss et al. . | |
| 4,040,782 | 8/1977 | Weiss et al. . | |
| 4,043,008 | 8/1977 | Weiss et al. . | |
| 4,082,160 | 4/1978 | Schilling et al. . | |
| 4,110,876 | 9/1978 | Weiss et al. . | |
| 4,111,279 | 9/1978 | Sterrett | 181/264 |
| 4,113,051 | 9/1978 | Moller | 181/243 |
| 4,116,303 | 9/1978 | Trudell | 181/252 |
| 4,124,092 | 11/1978 | Kajiya et al. . | |

OTHER PUBLICATIONS

Report 1192, "Theoretical and Experimental Investigation Of Mufflers With Comments on Engine–Exhaust Muffler Design", by D. D. Davis, Jr., et al., Langley Aeronautical Laboratory, pp. 4, 22, 23 and 45.

*Primary Examiner*—George H. Miller, Jr.
*Assistant Examiner*—Benjamin R. Fuller
*Attorney, Agent, or Firm*—Virginia S. Andrews

[57] ABSTRACT

A muffler for use in conjunction with a high intensity, low frequency noise-propagating open pipeline is disclosed. The muffler features an acoustically lined expansion chamber in tandem with a reasonator chamber. The length of the expansion chamber is approximately 25 percent of the wavelength to be attenuated. An exit tube, which passes through the resonator chamber to lead from the expansion chamber to the muffler outlet, is partially perforated with the perforations being restricted to at most the 50 percent of the exit tube closer to the muffler outlet. Audible noise which is emitted by the open pipeline is reduced by up to 30 dB and 11 Δ dB(A) and brought to within acceptable levels.

10 Claims, 2 Drawing Figures

VACUUM PUMP EXHAUST MUFFLER

BACKGROUND OF THE INVENTION

This invention relates to a muffler for use in conjunction with a high intensity, low frequency noise-propagating open pipeline. In particular, it relates to a muffler, for use in conjunction with an exhaust pipe leading from one or more vacuum pumps. For example, a vacuum system is used to convey polymer chips from one area to another in a plant. The muffler reduces by up to 30 dB and 11Δ dB(A) the noise emitted at the exit of the exhaust pipe.

Throughout the present specification and claims, the term "dB" (decibels) connotes the unit of measurement of sound pressure level as defined in ANSI Sl.4-1971, using a reference level of 20 micropascals ($2\times10^{-5}$ Newtons per square meter). The term "dB(A)" (decibels-A-weighted) connotes a unit of measurement of sound level corrected to the A-weighted scale, as defined in ANSI Sl.4-1971, using a reference level of 20 micropascals ($2\times10^{-5}$ Newtons per square meter). The term "Δ dB(A)" refers to the difference between two noise levels where each level is expressed in units of dB(A).

The muffler of this invention is useful any time an open pipe propagates noise, such as exhaust pipes from vacuum pumps which are widely used in industry. To convey polymer chips, the inlet of each vacuum pump is connected to a conveyance system and a partial vacuum is put on the system when the vacuum pump is started. The partial vacuum creates an unbalanced force to suck or drag polymer chips through the system. The pump compresses air to impart force to the air and consequently generates pulses, or sound waves. It is this noise that propagates down the exhaust pipe of the vacuum pump. The noise emitted, as measured approximately 15.24 centimeters (6 inches) to one side of the exhaust pipe exit, was 115 to 116 dB for an octave band center frequency of 125 cycles per second (hereafter cps), and 113 dB for an octave band center frequency of 250 cps, and 99 dB(A). As can be seen, the major noise component is of high intensity and in the low frequency range. Low frequency noise, while less harmful than high frequency noise, can be heard and is very annoying, especially in an otherwise quiet atmosphere.

The vacuum pump may be an intermittent or continuous source of noise. In either event, as a major contributor of noise or as a minor component in an area which has several other sources of noise, it is desirable to bring the noise level down to more acceptable limits.

Report 1192 of the National Advisory Committee for Aeronautics discloses mufflers which combine a resonator with an expansion chamber. U.S. Pat. No. 4,116,303 to Trudell discloses an exhaust muffler which provides two expansion chambers in series, wherein the second chamber has the dual function of serving as the second expansion chamber to improve low frequency noise reduction and as a resistive absorber to improve middle and high frequency noise reduction.

SUMMARY OF THE INVENTION

The present invention provides a muffler which comprises a housing, an inlet to the housing, an outlet from the housing, an elongated exit tube which communicates with the outlet and extends within the housing, and a partition. The partition is located in the annulus between the inner wall of the housing and the outer wall of the exit tube. The inlet end of the exit tube terminates at and in register with the opening in the partition. The partition forms with the housing an expansion chamber which includes the inlet. Further, the partition forms with the housing a resonator chamber which occupies the annular volume surrounding the exit tube. The cross-sectional area of the expansion chamber in a plane substantially parallel to the plane normal to the axis of the inlet is greater than the cross-sectional area of said plane of the inlet. The length of the expansion chamber from the inlet to the partition is approximately 25 percent of the wavelength to be attenuated. The inner wall of the housing which forms the expansion chamber is at least partially lined with sound absorbing material. The exit tube is partially perforated with the perforations being restricted to, at most, the 50 percent of the length of the exit tube closer to the outlet.

In the preferred embodiment, a vacuum pump exhaust pipe is coupled to the muffler which reduces the audible noise which is emitted at the exit of the exhaust pipe by up to 30 dB and 11Δ dB(A). The muffler comprises a generally cylindrical housing, an inlet to the housing which is connectable to a vacuum pump exhaust pipe, an outlet from the housing, an elongated exit tube, and a partition. The elongated exit tube, which is coaxially aligned with the inlet, passes from the outlet and extends within the housing. The exit tube has a plurality of perforations which are preferably restricted to the 25 percent or less of the length of the exit tube within the housing closer to the outlet to create a total open area for the exit tube of from about 0.8 to about 13.0 percent. The partition is located in the annulus between the inner wall of the housing and the outer wall of the exit tube. The inlet end of the exit tube terminates at and in register with the opening in the partition. The partition forms with the housing an expansion chamber which includes the inlet. The cross-sectional area of the expansion chamber in a plane substantially parallel to the plane normal to the axis of the inlet is greater than the above cross-sectional area of the inlet. The distance from the inlet to the partition in the expansion chamber is approximately 25 percent of the wavelength to be attenuated. The curved portion of the inner wall of the housing which forms a part of the expansion chamber is lined with sound absorbing material. The partition also forms with the housing a resonator chamber which occupies the annular volume surrounding the exit tube. The ratio of the volume in cubic inches of the resonator chamber to the distance in inches from the inlet to the partition in the expansion chamber is from about 27 to 1 up to 110 to 1.

The expansion chamber and resonator chamber are each tuned to low frequency noise, and in tandem operate to attenuate noise in octave band center frequencies of up to 500 cycles per second.

The invention will be more clearly understood and additional objects and advantages will become apparent upon reference to the discussion below and to the drawings which are given for illustrative purposes.

DETAILED DESCRIPTION OF THE DRAWINGS

Figure 1:
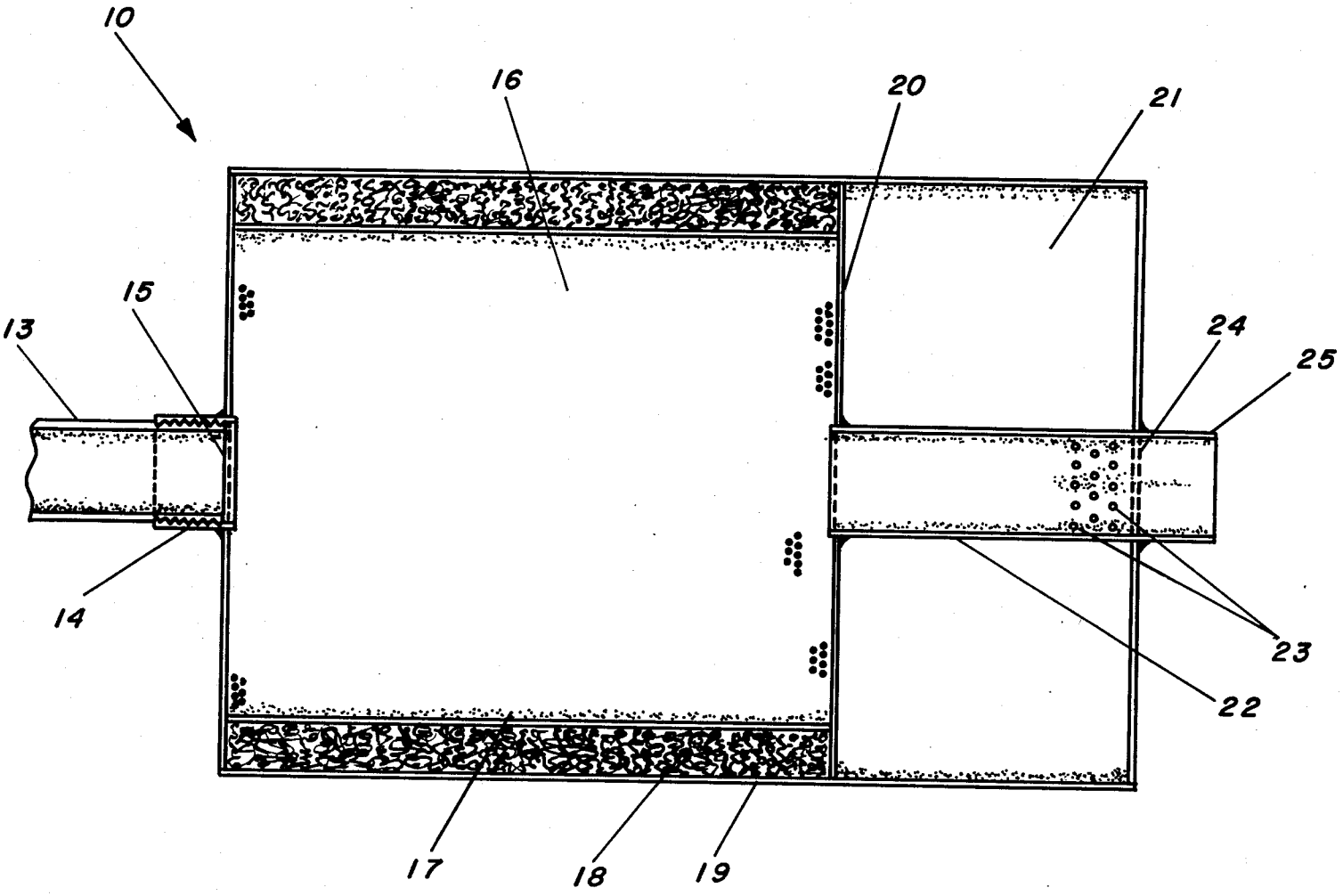
FIG. 1 is a vertical cross-section of the muffler of the present invention coupled with an exhaust pipe leading from one or more vacuum pumps.

In the accompanying drawings, like numbers indicate like apparatus. Referring to FIG. 1 muffler 10 comprises generally cylindrical housing 19, inlet 15 to housing 19, outlet 24 from housing 19, elongated exit tube 22, and partition 20. Exit tube 22, which is coaxially aligned with inlet 15, passes from outlet 24 and extends within housing 19 as shown. Exit tube 22 has a plurality of perforations 23 which are restricted to less than the 50 percent, more preferably to less than the 25 percent, of the length of exit tube 22 within housing 19 closer to outlet 24 to create a total open area for exit tube 22 within housing 19 of from 0.8 to about 13.0 percent. The total open area of exit tube 22 does not include its two ends. Partition 20, an annular baffle, is located in the annulus between the inner wall of housing 19 and the outer wall of exit tube 22. The inlet end of exit tube 22 terminates at and is substantially in register with the opening in partition 20 by which it is supported. By inlet end is meant the end closer to inlet 15. Thus, partition 20 forms with housing 19 an expansion chamber 16 which includes inlet 15. The cross-sectional area of expansion chamber 16 in a plane substantially parallel to the plane normal to the axis of inlet 15 is greater than the above cross-sectional area of inlet 15. The distance from inlet 15 to partition 20 in expansion chamber 16 is approximately 25 percent of the sound wavelength to be attenuated. The curved portion of the inner wall of housing 19 which forms a part of expansion chamber 16 is lined with sound absorbing material 18. Partition 20 also forms with housing 19 a resonator chamber 21 which occupies the annular volume surrounding exit tube 22. The ratio of the volume in cubic inches of resonator chamber 21 to the distance in inches from inlet 15 to partition 20 in expansion chamber 16 is from about 27 to 1 up to 110 to 1.

In the preferred embodiment, muffler 10 is coupled via coupling means 14 to exhaust pipe 13, coupling means 14 being internally threaded to mate with the external threading of exhaust pipe 13 (a half coupling). The fluid, normally air, flowing through exhaust pipe 13 from, for example, vacuum pumps, carries with it sound waves generated during operation of the vacuum pumps. The sound waves propagate down exhaust pipe 13 of fixed cross-sectional area and encounter expansion chamber 16 with its larger cross-sectional area. The change in cross-sectional area creates an impedence mismatch and reflects some of the sound waves back up exhaust pipe 13. Those sound waves which "escape" and continue to propagate in expansion chamber 16 may encounter one of three things: sound absorbing material 18, partition 20, or exit tube 22.

Sound absorbing material 18 is an acoustic liner which is preferably held in place by perforated sheet metal retainer 17 and which dissipates sound by transforming the acoustical mechanical energy of the sound waves into thermal energy. Retainer 17, which can be formed of expanded metal, has an open area of from 35 to 95 percent, more preferably from about 60 to 90 percent, and is detachably secured by means of, for example, screws, to housing 19 so that sound absorbing material 18 is retained thereby. An open area of under 35 percent decreases the absorption of sound waves by sound absorbing material 18, and an open area of greater than 95 percent decreases the retentive function of the perforated sheet metal retainer 17 to a critical degree. Although sound absorbing material 18 can be affixed to the interior of housing 19 in other fashions, for example by gluing or bonding (see FIG. 2), perforated sheet metal retainer 17 maximizes the noise reduction capability of sound absorbing material 18 and is more durable. In the preferred embodiment, sound absorbing material 18 functions as an absorptive medium, and it is therefore unnecessary to line more of the interior of expansion chamber 16 since further lining contributes only marginally to the reduction of noise.

Partition 20 is located at a distance of 25 percent of the sound wavelength to be attenuated from inlet 15. This distance is referred to as the length of expansion chamber 16. The octave band center frequencies for which expansion chamber 16 and resonator chamber 21 have been tuned range from about 125 cps to about 500 cps. Thus, the length of expansion chamber 16 will ordinarily range from about 15 centimeters to about 61.5 centimeters (about 6 inches to about 24 inches) for a corresponding decrease from 500 cps to 125 cps. Sound waves which encounter partition 20 are reflected or ricocheted to cancel some of the sound waves propagating into expansion chamber 16 behind them.

Figure 2:
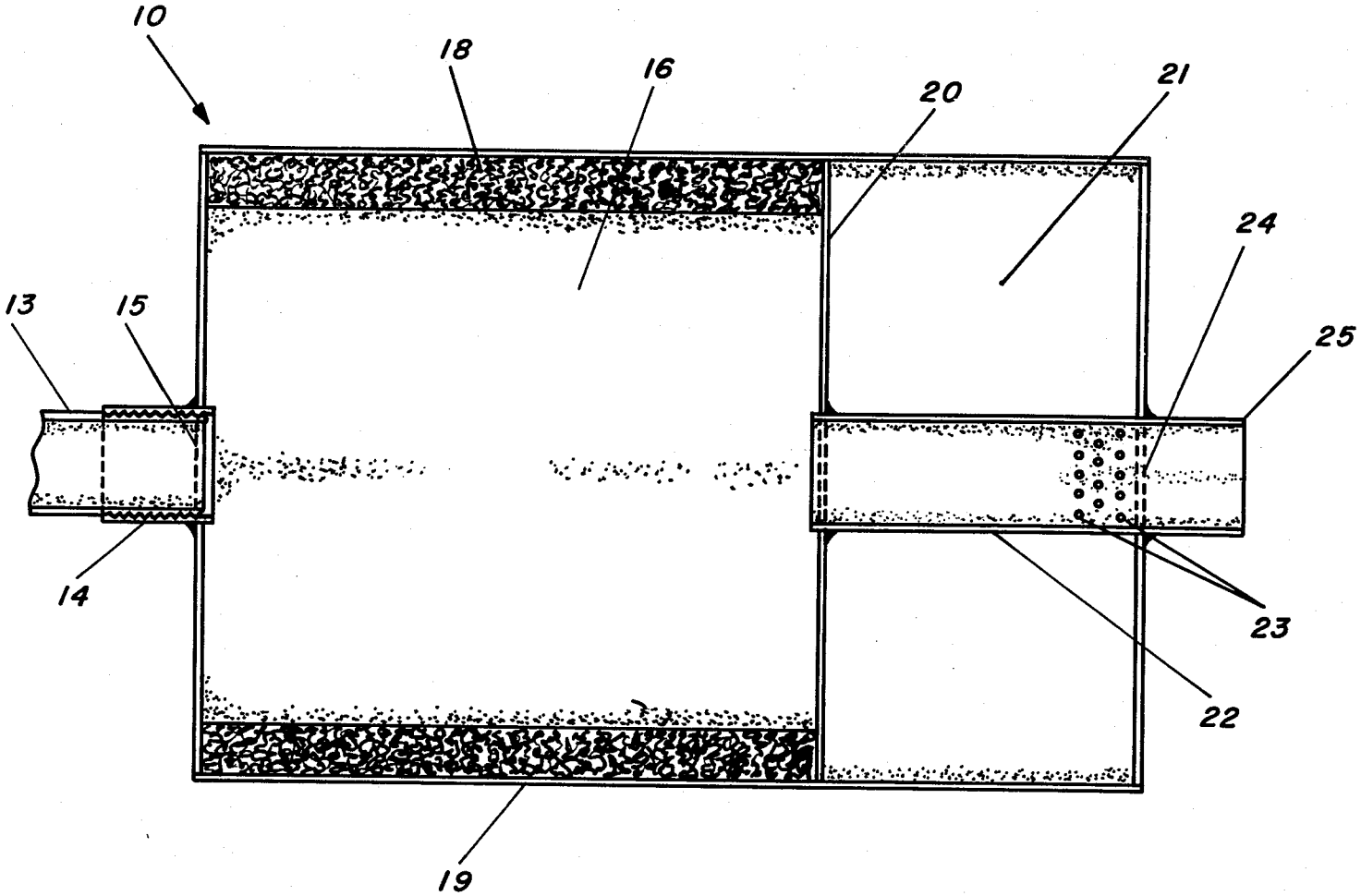
FIG. 2 is a vertical cross-section of an alternate embodiment of the muffler of the present invention coupled with an exhaust pipe.

Reference to FIGS. 1 and 2 will show that exit tube 22 is preferably coaxially aligned with and has approximately the same cross-sectional area as inlet 15. While the present invention encompasses use of an offset exit tube 22, the pressure drop created thereby necessitates an increased use of energy for the vacuum pumps to exhaust gases. Further, more than one exit tube 22 can be employed. Sound waves which "escape" the previously described noise attenuation means and which propagate through expansion chamber 16 to exit tube 22 must neck down (contract) to the lower cross-sectional area of exit tube 22 as compared with expansion chamber 16. This causes another impedence mismatch to ricochet some of the sound waves back into expansion chamber 16 where sound wave cancellation takes effect in addition to the previously described noise attenuation means. The volume of reasonator chamber 21, the number, size and location of perforations 23 in exit tube 22, and the thickness of exit tube 22 are all highly interdependent and must be balanced to tune resonator chamber 21 to a particular resonance frequency. Resonator chamber 21 is, in the preferred embodiment, tuned to handle octave band center frequencies of between 125 cps and 500 cps. Some of the sound waves which propagate down exit tube 22 and encounter perforations 23 will be reflected back up exit tube 22 at the mentioned frequencies due to yet another impedence mismatch. Some of the sound waves will pass through perforations 23 into resonator chamber 21. The uniform vibration of the small plugs of air in perforations 23 as sound waves propagate down exit tube 22 causes sound wave reflections and cancellations. And finally, those few sound waves that "escape" to pass completely through muffler 10, exit from outlet 24, or as shown in the drawings, from tailpipe 25, where yet another impedence mismatch occurs to reflect the sound waves back up exit tube 22 to be cancelled or encounter one of the previously mentioned noise attenuation means. It should be noted that tailpipe 25 can be an extension of tube 22; use of tailpipe 25 is optional.

The materials of construction for muffler 10 are preferably as follows: for the sound absorbing material, an open-celled foam, for example fine pore polyester urethane foam; for the perforated tube and retainer, a metal such as aluminum; and for the other elements, a metal such as stainless steel or aluminum, more preferably the latter for reasons of economy.

EXAMPLE 1

The apparatus of the present invention was set up as shown in FIG. 1, and tuned for an octave band center frequency of 250 cps. The cross-sectional area of exhaust pipe 13 was approximately 20.3 square centimeters (3.14 square inches). The length of expansion chamber 16 was approximately 30.5 centimeters (12 inches). Perforations 23, which had a diameter of about 0.48 centimeters (0.1875 inches), were forty-five in number (three rows with fifteen perforations per row) to create a total open area of approximately 3.3 percent for exit tube 22. Perforations 23 were restricted to the 20 percent of exit tube 22 within housing 19 closer to outlet 24. The ratio of the volume in cubic inches of resonator chamber 21 to the length in inches of expansion chamber 16 was approximately 54.4 to 1. It should be noted that the volume of resonator chamber 21 does not include the volume occupied or encompassed by exit tube 22. A one-inch layer of fine pore polyester urethane foam was utilized as sound absorbing material 18, more specifically Scottfelt Grade 3-900 manufactured by the Scott Paper Company, Foam Division. The noise level was measured 15.24 centimeters (6 inches) to one side of the exit of tailpipe 25. The noise level with muffler 10 was 88 dB(A), which represents a dynamic insertion loss of 11Δ dB(A) when compared with the 99dB (A) noise level measured approximately 15.24 centimeters (6 inches) to one side of the exit of exhaust pipe 13 without muffler 10. Even more dramatic is the dynamic insertion loss when measuring low frequency noise. Measurements taken in the same manner as described above for an octave band center frequency of 250 cps show a 29 dB insertion loss (84 to 85 dB with muffler 10 and 113 dB without muffler 10). Table I below lists some of the changes in the parameters of this example which will result in attenuation of noise in the frequencies listed at the left. For an octave band center frequency of 125 cps the dynamic insertion loss is 30 dB (86 dB with muffler 10 and 115 to 116 dB without muffler 10).

TABLE I

| Frequency | Expansion Chamber Length (in inches) | Resonator Chamber Volume (in cubic inches) | Exit Tube Open Area |
|---|---|---|---|
| 125 cps | 24 | 2610 | 0.8% |
| 177 cps | 18 | 1305 | 1.6% |
| 353 cps | 9 | 326.25 | 6.4% |
| 500 cps | 6 | 163.125 | 12.8% |

Example 1 above illustrates the preferred muffler of the present invention and is not to be considered limiting of the invention in any means. Various modifications and other advantages will be apparent to one skilled in the art, and it is intended that this invention be limited only as set forth in the following claims. For example, although housing 19 forms a common boundary for both expansion chamber 16 and resonator chamber 21, discrete boundary-forming housing means could be utilized which have differing cross-sectional areas. Further, while depicted as generally cylindrical, housing 19 could have other shapes; similarly for inlet 15, outlet 24, and exit tube 22.

What is claimed is:

1. A muffler comprising:
(a) a housing;
(b) an inlet to said housing;
(c) an outlet from said housing;
(d) an elongated exit tube communicating with said outlet and extending within said housing; and
(e) a partition being located in the annulus between the inner wall of said housing and the outer wall of said exit tube, the inlet end of said exit tube terminating at and substantially in register with the opening in said partition, said partition forming with said housing an expansion chamber which includes said inlet, said partition forming with said housing a resonator chamber occupying the annular volume surrounding said exit tube, the cross-sectional area of said expansion chamber in a plane substantially parallel to the plane normal to the axis of said inlet being greater than the cross-sectional area of said plane of said inlet, the length of said expansion chamber from said inlet to said partition being approximately 25 percent of the wavelength to be attenuated, the inner wall of said housing which forms said expansion chamber being at least partially lined with sound absorbing material, said exit tube being partially perforated with the perforations being restricted to at most the 50 percent of the length of said exit tube within said housing closer to said outlet.

2. A muffler as defined in claim 1 wherein said exit tube is coaxially aligned with said inlet.

3. A muffler as defined in claim 1 wherein said perforations create a total open area for said exit tube of from about 0.8 to about 13.0 percent.

4. A muffler as defined in claim 1 wherein the ratio of the volume in cubic inches of said resonator chamber to the distance in inches from said inlet to said partition means in said expansion chamber is from about 27 to 1 up to 110 to 1.

5. A muffler as defined in claim 1 wherein said perforations are restricted to the 25 percent or less of the length of said exit tube within said housing closer to said outlet.

6. A muffler as defined in claim 1 wherein said sound absorbing material is an open-celled foam.

7. A muffler as defined in claim 6 wherein said open-celled foam is a fine pore polyester urethane foam.

8. A muffler as defined in claim 1 wherein said housing means has a substantially cylindrical shape.

9. A muffler, for use in conjunction with a vacuum pump exhaust pipe, comprising:
a. a generally cylindrical housing;
b. an inlet to said housing which is connectable to a vacuum pump exhaust pipe;
c. an outlet from said housing;
d. an elongated exit tube communicating with said outlet and extending within said housing, said exit tube being coaxially aligned with said inlet, said exit tube having a plurality of perforations which are restricted to the 25 percent or less of the length of said exit tube within said housing closer to said outlet to create a total open area for said exit tube of from about 0.8 to about 13.0 percent; and
e. a partition being located in the annulus between the inner wall of said housing and the outer wall of said exit tube, the inlet end of said exit tube terminating at and in register with the opening in said partition, said partition forming with said housing an expansion chamber which includes said inlet, the cross-sectional area of said expansion chamber in a plane substantially parallel to the plane normal to the axis of said inlet being greater than the cross-sectional area of said plane of said inlet, the distance from said inlet to said partition in said expansion chamber being approximately 25 percent of the wavelength to be attenuated, the curved portion of said inner wall of said housing which forms a part of said expansion chamber being lined with sound absorbing material, said partition forming with said housing a resonator chamber occupying the annular volume surrounding said exit tube, the ratio of the volume in cubic inches of said resonator chamber to the distance in inches from said inlet to said partition in said expansion chamber being from about 27 to 1 up to 110 to 1.

10. A muffler as defined in claim 9 which further comprises an open area sheet-like material which is shaped to substantially conform to the contours of the interior of said housing which is lined with said sound absorbing material, said open area sheet-like material being removably attached to said housing with said sound absorbing material placed therebetween and retained by said open area sheet-like material.

* * * * *